US008517853B2

(12) United States Patent
Miller et al.

(10) Patent No.: US 8,517,853 B2
(45) Date of Patent: Aug. 27, 2013

(54) TRAINING SYSTEM AND METHOD OF USING THE SAME

(76) Inventors: Brad Miller, Holliston, MA (US); John Miller, Holliston, MA (US)

( * ) Notice: Subject to any disclaimer, the term of this patent is extended or adjusted under 35 U.S.C. 154(b) by 0 days.

(21) Appl. No.: 13/310,313

(22) Filed: Dec. 2, 2011

(65) Prior Publication Data

US 2012/0302363 A1 Nov. 29, 2012

Related U.S. Application Data

(60) Provisional application No. 61/519,728, filed on May 27, 2011.

(51) Int. Cl.
*A63B 69/36* (2006.01)

(52) U.S. Cl.
USPC ..... 473/270; 473/269

(58) Field of Classification Search
USPC ..... 473/218, 262, 266, 269, 270, 271, 473/272, 278, 452
See application file for complete search history.

(56) References Cited

U.S. PATENT DOCUMENTS

| | | | | |
|---|---|---|---|---|
| 2,189,613 | A * | 2/1940 | Paulsen | 473/270 |
| 3,955,821 | A * | 5/1976 | Spedding | 473/271 |
| 4,023,810 | A * | 5/1977 | Lorang | 473/218 |
| 4,037,847 | A * | 7/1977 | Lorang | 473/269 |
| 4,146,231 | A * | 3/1979 | Merkle et al. | 473/269 |
| 5,150,902 | A * | 9/1992 | Heisler | 473/269 |
| 5,263,863 | A * | 11/1993 | Stefani et al. | 473/269 |
| 7,488,265 | B2 * | 2/2009 | Miller et al. | 473/452 |

* cited by examiner

*Primary Examiner* — Nini Legesse
(74) *Attorney, Agent, or Firm* — Kriegsman & Kriegsman

(57) ABSTRACT

A golf training system includes a stationary front foot support, a pivotable rear foot support and a raised ball support. The pivotable rear foot support includes a rectangular mounting bracket transversely disposed across an enlarged base and a flat balance plate that directly teeters on the mounting bracket. In use, the golf training system can be used to promote proper weight distribution throughout a golf swing using sensory and auditory feedback. Specifically, the golfer disposes the rear foot on top of the balance plate and the front foot across the stationary front foot support with body weight maintained on the inner portion of the rear leg throughout the backswing. The golfer initiates the downswing by firing the hips open and driving the lower body forward until the balance plate pivots and strikes the base, thereby providing the user with immediate audible and tactile response of proper execution.

12 Claims, 8 Drawing Sheets

TRAINING SYSTEM AND METHOD OF USING THE SAME

CROSS-REFERENCE TO RELATED APPLICATIONS

The present application claims the benefit under 35 U.S.C. 119(e) of U.S. provisional Patent Application Ser. No. 61/519,728, filed May 27, 2011, the disclosure of which is incorporated herein by reference.

BACKGROUND OF THE INVENTION

The present invention relates generally to athletic training devices and more particularly to golf swing training aids that are designed to reinforce the utilization of proper mechanics.

A golfer is required to engage in a well-timed and fluid sequence of interrelated actions in order to swing a golf club in a technically sound manner. Specifically, a technically proper golf swing requires that the golfer first set-up, or address the golf ball, in the proper fashion. Accordingly, the golfer stands sideways (i.e., at a right angle) relative to the intended target with the ball located slightly in front of the golfer, the ball aligning between the front and rear feet. With knees slightly bent and eyes firmly directed at the golf ball, the golfer pivots about the hips so that the spine extends straight at an approximate 45 degree angle relative to the hitting surface. Gripping the club in the proper manner, the arms are extended straight so that the head of the golf club is disposed directly behind the golf ball.

While disposed in the proper set-up position, the golfer commences the golf swing by coiling the torso rearward until the back of the golfer faces the intended target. With the body coiled as such, it is to be understood that the arms draw the head of the golf club up and behind the golf ball along a planar arcuate path until the shaft of the club similarly extends in the direction of the intended target, thereby completing the backswing portion of the golf swing.

During execution of the backswing, it is essential that the lower body remain fixed and stable, with the center of gravity for the golfer held firmly in alignment with the inner portion of the rear leg. In this capacity, it is to be understood that the majority of the weight of the golfer is effectively loaded in the inner portion of the rear hip, leg and foot, this condition being referred to herein as "inner rear loading." Rearward displacement of body weight outside the rear leg, which is commonly referred to as "swaying" in the art, can result in the rearward travel of the club head along a path other than the desired planar arcuate path (e.g., along a considerably steeper path), which is highly undesirable.

To initiate the downswing, the golfer rapidly uncoils, or fires, the hips without lifting either foot off the ground. Through this rapid hip rotation, a quick explosion of lower body power is created that drives the center of gravity of the golfer linearly forward from the inner portion of the rear hip, leg and foot. The rapid firing of hips and resulting acceleration of body weight linearly forward similarly powers the rapid successive rotation of the torso, shoulders, arms and hands of the golfer as part of a kinetic chain of movement that is commonly referred to as the "kinetic link theory" in the art. This rapid chain of rotation causes the golf club to release during impact with considerable acceleration and force, which is highly desirable.

As can be appreciated, the utilization of proper mechanics when hitting a golf ball is highly encouraged. The use of proper swing mechanics serves to, among other things, (i) maximize club head speed through impact, (ii) guide the club head through the ideal swing plane and thereby improve accuracy, and (iii) minimize stress on the upper body by relying largely on lower body muscular power to drive the swing, thereby reducing the likelihood of injury.

Although proper swing mechanics are well known in the art, golfers nonetheless regularly exhibit a number of common mechanical flaws. In particular, it has been found that golfers commonly commit at least some of the following swing flaws, namely, (i) engaging in a rearward, or backward, weight shift during the backswing (i.e., swaying), or (ii) failing to initiate the downswing by firing the hips of the golfer open (e.g., by primarily using the arms to drive the club into impact along an "over-the-top" swing path). As noted above, by maintaining a stable lower body during the backswing and, in turn, initiating the downswing by firing the hips open, the lower body of golfer is able to fuel, or drive, rotation of the upper body, thereby maximizing club head speed and power through impact.

Traditionally, golfers rely on instructors and/or video equipment to monitor the extent that golfers maintain a stable lower body during the backswing and, in turn, initiate the downswing by firing the hips open to create a linear power move. Although useful, instructors and/or video equipment are not always readily available for a golfer and, in addition, can be relatively expensive in nature.

Accordingly, portable swing aids are well known in the art and are commonly used by golfers to improve performance. However, most swing aids are designed primarily to guide club head travel along the proper swing plane and are not specifically designed to maximize power and accuracy by teaching a golfer to maintain a stable lower body during the backswing and, in turn, initiate the downswing by firing the hips open to create a linear power move.

SUMMARY OF THE INVENTION

It is an object of the present invention to provide a novel golf swing training system that is designed to reinforce the utilization of proper mechanics.

It is another object of the present invention to provide a training system as described above that is designed to train a golfer to maintain a stable lower body during the backswing.

It is yet another object of the present invention to provide a training system as described above that is designed to train a golfer to initiate the downswing by firing the hips so as to create a forward linear lower body power move.

It is still another object of the present invention to provide a training system as described above that has a limited number of parts, is inexpensive to manufacture, is easy to use and is highly portable in nature.

Accordingly, as one feature of the present invention, there is provided a training system comprising (a) a pivotable rear foot support, the rear foot support comprising (i) a support member, and (ii) a balance plate pivotally coupled to the support member, the balance plate having a flat top surface, a flat bottom surface, a front end and a rear end, the balance plate being adapted to teeter in both the forward and rearward direction, the balance plate being naturally biased to balance on the support member along a generally horizontal plane in the absence of a force applied thereto, and (b) a stationary front foot support.

As another feature of the present invention, there is provided a method of training a golfer to swing using proper mechanics, the method comprising the steps of (a) providing a training system that comprises a stationary front foot support and a pivotable rear foot support, the rear foot support comprising a support member and a balance plate pivotally coupled to the support member, the balance plate having a flat top surface, a flat bottom surface, a front end and a rear end, the balance plate being adapted to teeter in both the forward and rearward direction, the balance plate being naturally biased to balance on the support member along a generally horizontal plane in the absence of a force applied thereto, (b) placing the front foot of the golfer transversely across the front foot support and the rear foot of the golfer transversely across the rear foot support, (c) maintaining the weight of the golfer in alignment with the inner portion of the rear hip, leg and foot during the backswing, (d) initiating the downswing through rotation of the hips, thereby transferring the weight of the golfer linearly forward such that the balance plate pivots forward and contacts the support member, and (e) after the initiating step, rotationally driving the torso of the golfer to swing the golf club.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIGS. 2(*d*)-(*e*) are top perspective and left end views, respectively, of the balance device shown in FIG. 1, the device being shown with its balance plate pivoted forward so as to contact the ground plate;

DETAILED DESCRIPTION OF THE PREFERRED EMBODIMENT

Figure 1:
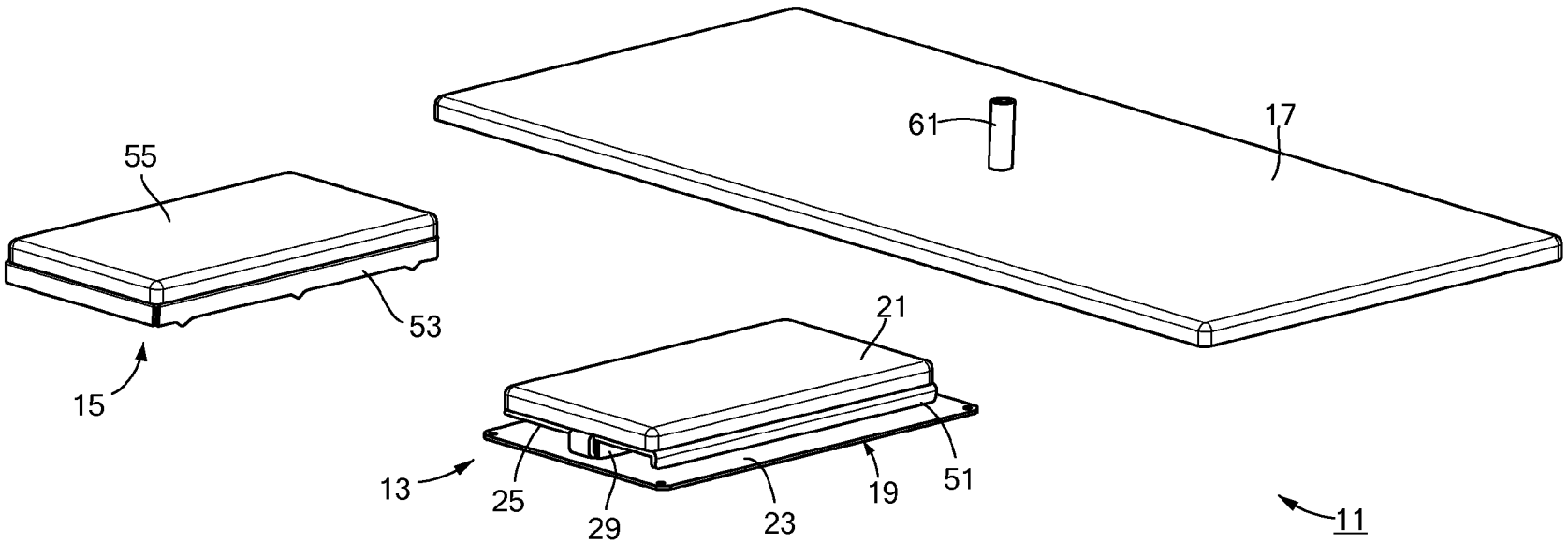
FIG. 1 is a top perspective view of a training system that is constructed according to the teachings of the present invention.
Figure 2A:
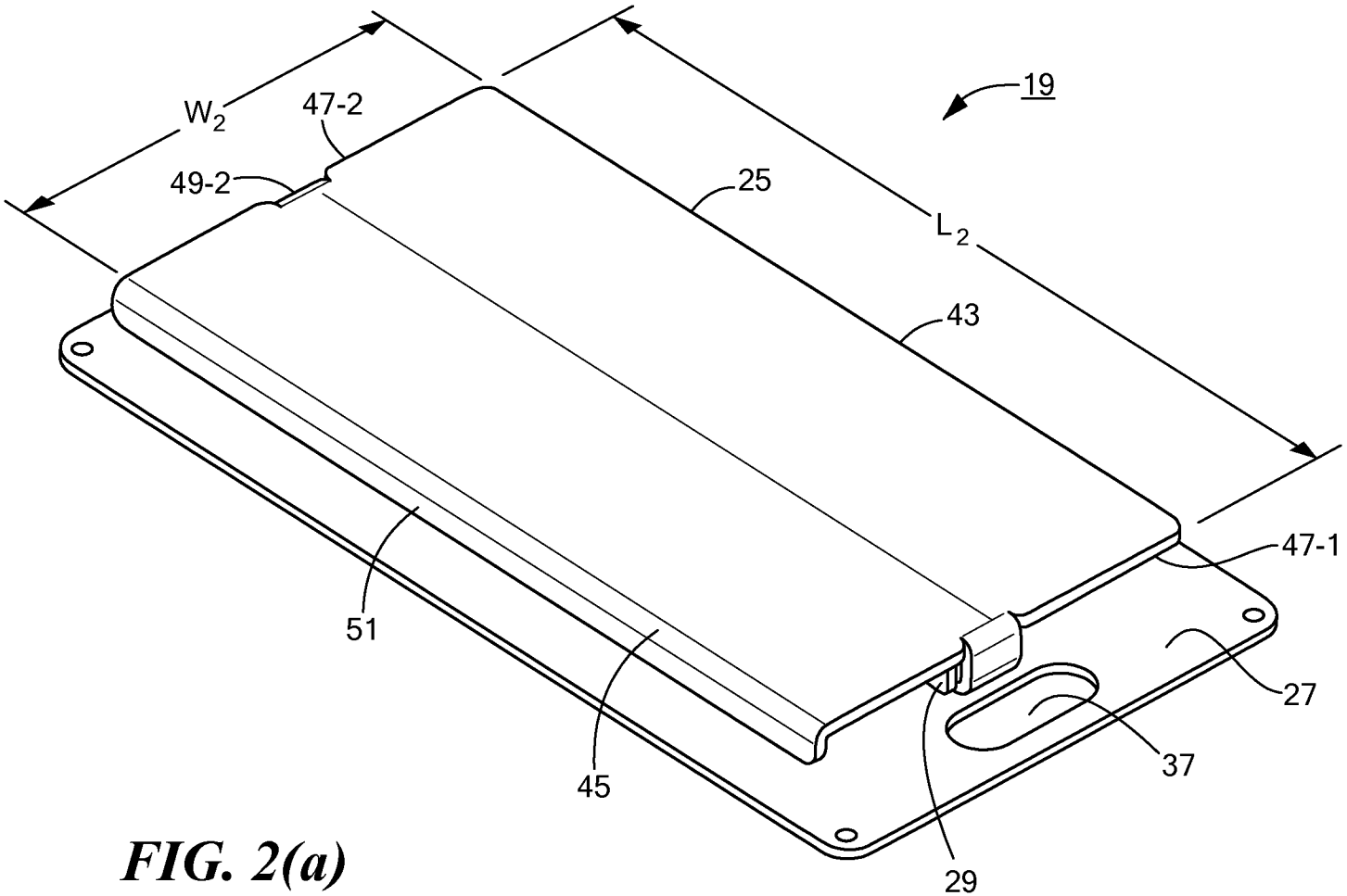
FIGS. 2(*a*)-(*c*) are top perspective, top plan and right end views, respectively, of the balance device shown in FIG. 1, the device being shown with its balance plate disposed in its natural, generally horizontal position.
Figure 2B:
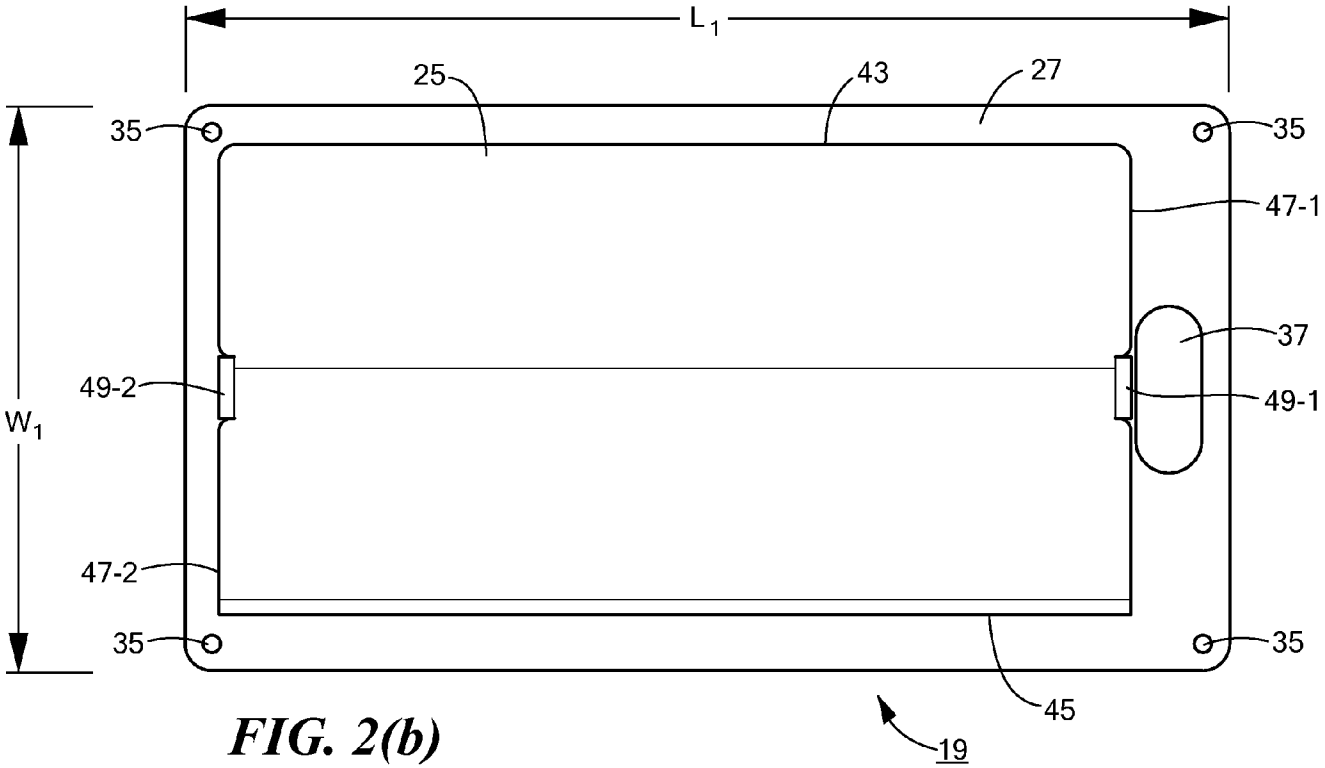
Figure 2C:
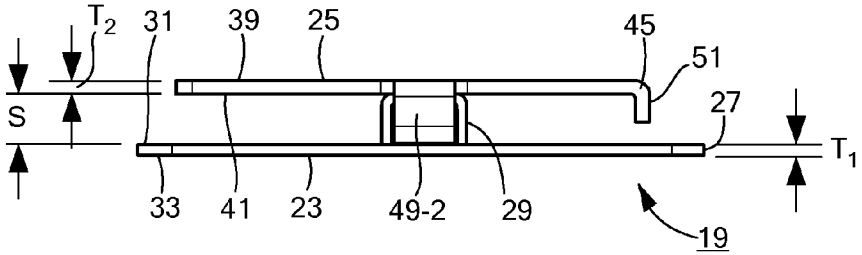
Figure 2D:
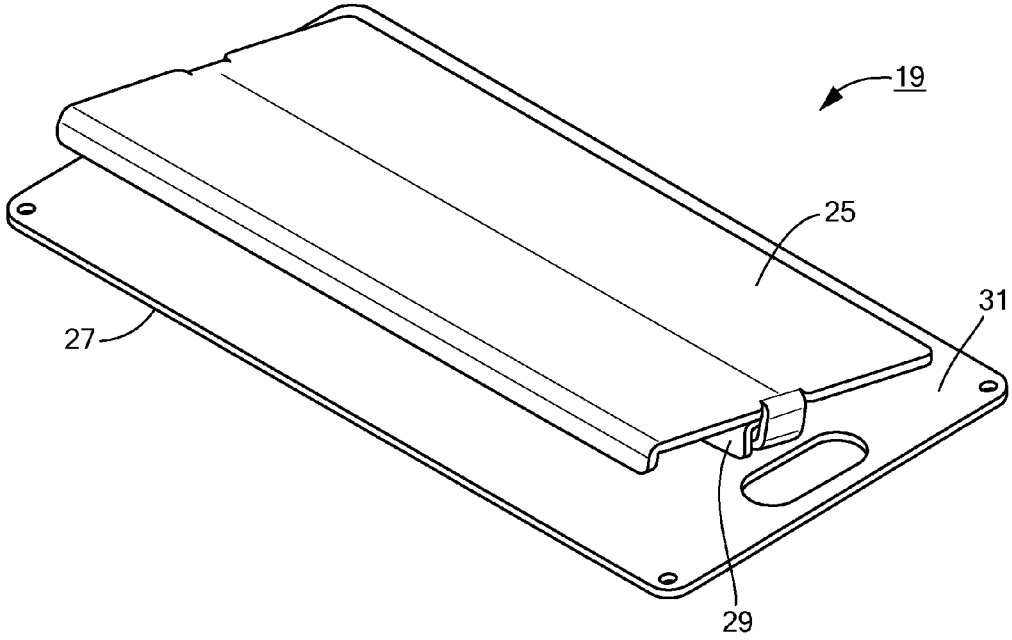
Figure 2E:
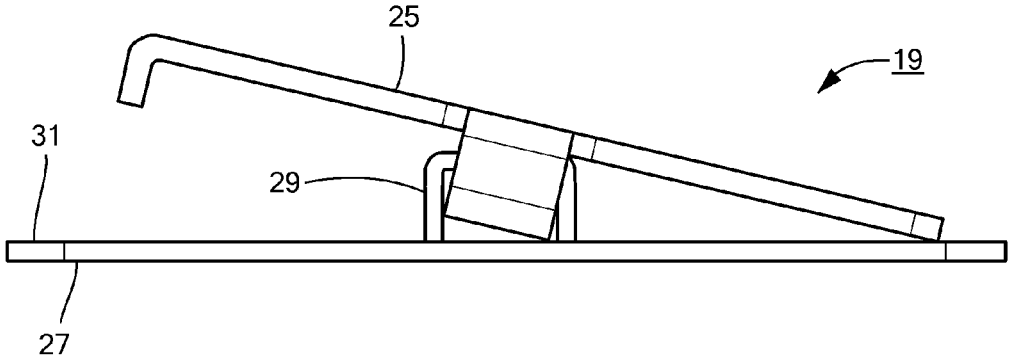

Referring now to FIG. 1, there is shown a top perspective view of a training system constructed according to the teachings of the present invention, the training system being identified generally by reference numeral 11. As will be described further in detail below, training system 11 is a golf swing aid that is designed to reinforce the utilization of proper mechanics. More specifically, training system 11 is designed principally to promote the proper timing of body weight transfer during a typical golf swing, thereby maximizing power and improving accuracy, which are principal objects of the present invention.

For purposes of simplicity only, training system 11 is described herein as being used as an aid for teaching proper weight distribution during the process of hitting a golf ball. However, it is to be understood that training system 11 is not limited to use in connection with hitting a golf ball. Rather, it is to be understood that training system 11 could be used in any sports training application that requires means for sensing weight distribution during the process of hitting or striking an object (e.g., in connection with softball, baseball, hockey, tennis or other similar sports activities).

Golf swing training system, or kit, 11 comprises a pivotable rear foot support 13, a stationary front foot support 15 and a raised ball support 17. In use, a golfer stands with his/her rear foot on rear foot support 13 and his/her front foot on front foot support 15. With a ball disposed on ball support 17, the golfer engages in a typical golf swing and strikes the ball. Due to the pivotable nature of rear foot support 13, the golfer can use auditory and tactile feedback to determine the effectiveness and proper timing of weight transfer during the golf swing, as will be described further in detail below.

In the present embodiment, supports 13, 15 and 17 are represented as three separate components. However, it should be noted that supports 13, 15 and 17 need not be separately constructed. Rather, it is to be understood that two or more of the components could be integrated together without departing from the spirit of the present invention.

Rear foot support 13 is a unitary device that includes a pivotable balance device 19 on which is mounted a synthetic turf pad 21. As will be described in detail below, the pivotable nature of balance device 19 provides the user with immediate auditory and tactile response of weight distribution during an executed golf swing.

Referring now to FIGS. 2(*a*)-(*e*), balance device 19 comprises a support member 23 onto which is pivotally coupled a balance plate 25. As can be appreciated, balance plate 25 is adapted to teeter forward and/or rearward on support member 23 in response to the transfer of weight during a typical golf swing, thereby providing the golfer with immediate detectable feedback.

Support member 23 comprises an enlarged base, or ground plate, 27 and a transverse mounting bracket, or fulcrum, 29. For simplicity purposes only, base 27 and bracket 29 are represented as two separately constructed pieces that are subsequently joined together (e.g., through spot welding). However, it is to be understood that support member 23 could be alternatively constructed as a unitary member without departing from the spirit of the present invention.

Base 27 is preferably formed as a unitary member that is constructed out of a rigid and durable material, such as a lightweight aluminum, plastic or composite thereof. Base 27 includes a generally flat top surface 31 and a generally flat bottom surface 33 that together provide base 27 with a uniform thickness $T_1$ of approximately 0.19 inches.

As seen most clearly in FIG. 2(*b*), base 27 is generally rectangular in shape and includes an overall length $L_1$ of approximately 16.00 inches and an overall width $W_1$ of approximately 8.50 inches. Four circular holes 35 are formed in base 27 and extend transversely therethrough. Each hole 35 is located within a corresponding corner of base 27 and has a diameter of approximately 0.25 inches. It is to be understood that a pin or other similar fastening element can be driven through each hole 35 and into the ground surface in order to fix the location of balance device 19 and thereby prevent sliding.

Base 27 is additionally shaped to include an elongated transverse slot 37 along its left side edge, slot 37 being that is dimensioned to receive a plurality of fingers. In this capacity, it is to be understood that the left side of base 27 serves as an integral handle for carrying rear foot support 13, which is highly desirable.

Elongated rectangular mounting bracket, or fulcrum, 29 has an inverted U-shape in transverse cross-section and is approximately 0.75 inches in height. Mounting bracket 29 extends transversely across top surface 31 of base 27 along its center line and includes a plurality of rectangular tabs that are dimensioned to fittingly protrude into corresponding slots in base 27. The rectangular tabs on mounting bracket 29 are then permanently secured to base 27 by any conventional means (e.g., by spot welding the tabs on mounting bracket 29 to the portion of base 27 that immediately defines the slots). With bracket 29 assembled to base 27, a laterally extending channel (not shown) is defined therebetween, the function of the channel to become apparent below.

As seen most clearly in FIG. 2(*c*), balance plate 25 is pivotally coupled to bracket 19 and is designed to teeter forward and backward thereon. Balance plate 25 is a unitary piece that is preferably constructed of a rigid and durable material, such as a lightweight aluminum, plastic or composite thereof. Balance, or standing, plate 25 is represented herein as an enlarged, generally rectangular member that is shaped to include a substantially flat top surface 39, a substantially flat bottom surface 41, a straight front end 43, a straight rear end 45 and a pair of opposing straightened sides 47-1 and 47-2.

Balance plate 25 preferably has an overall length $L_2$ of approximately 14.00 inches, an overall width $W_2$ of approximately 7.00 inches and a thickness $T_2$ of approximately 0.13 inches. As such, balance plate 25 is appropriately dimensioned to teeter on bracket 29 and, in turn, support the rear hitting foot of a variety of different sized users. However, it is to be understood that balance plate 25 is not limited to the particular size and/or shape set forth above. Rather, the particular configuration and/or dimensions of balance plate 25 could be modified without departing from the spirit of the present invention.

Balance plate 25 is shaped to include a pair of opposing retention arms 49-1 and 49-2 that are integrally formed onto sides 47-1 and 47-2, respectively. Each retention arm 49 is generally L-shaped in transverse cross-section and includes an upper portion that extends orthogonally down from bottom surface 41 and a lower portion that extends orthogonally inward from the free end of the upper portion. As will be described further in detail below, L-shaped retention arms 49 selectively bracket 29 to keep balance plate 31 loosely coupled thereto.

Balance plate 25 is additionally shaped to include a negative feedback projection, or flange, 51 that is integrally formed onto rear end 45. Projection 51 is represented herein as a rectangular tab, approximately 0.41 inches in height, that extends orthogonally down from bottom surface 41 at rear end 45. It should be noted that the spacing S between bottom surface 41 of balance plate 31 and top surface 31 of base 27 is approximately 0.75 inches. Accordingly, it is to be understood that shortened projection 51 is sized and shaped to extend only a portion (approximately one-half) of the distance between bottom surface 41 of balance plate 25 and top surface 31 of base 27, as seen most clearly in FIG. 2(*c*). In this capacity, projection 51 is designed to contact top surface 31 of base 27 upon any limited rearward teetering of balance plate 25 on bracket 29, thereby providing the user with detectable feedback that rearward weight shift has occurred at any point of the golf swing (and, in particular, during the backswing). Because rearward weight shift is considered an undesirable component of a proper golf swing, projection 51 is referred to herein as providing "negative feedback" to the user.

With balance device 19 in its fully assembled form, bottom surface 41 of balance plate 25 lies directly on the flattened top surface of mounting bracket 29, as seen most clearly in FIG. 2(*c*). Furthermore, the free ends of retention arms 49 project into opposite ends of the channel defined between bracket 29 and base 27, thereby permanently coupling balance plate 25 to support member 23 (i.e., precluding vertical or lateral separation of components).

It should be noted that balance device 13 is designed such that there is considerable clearance (i.e., spacing) between retention arms 49 and mounting bracket 29 when balance plate 25 lies in its natural horizontal orientation, as shown in FIGS. 2(*a*)-(*c*). As a result of this loose coupling, balance plate 25 is capable of teetering forward, as shown in FIGS. 2(*d*) and 2(*e*), or rearward on bracket 29 (i.e., with mounting bracket 29 serving as the fulcrum, or balance point, about which balance plate 25 is able to pivot relative to base 27).

Figure 3A:
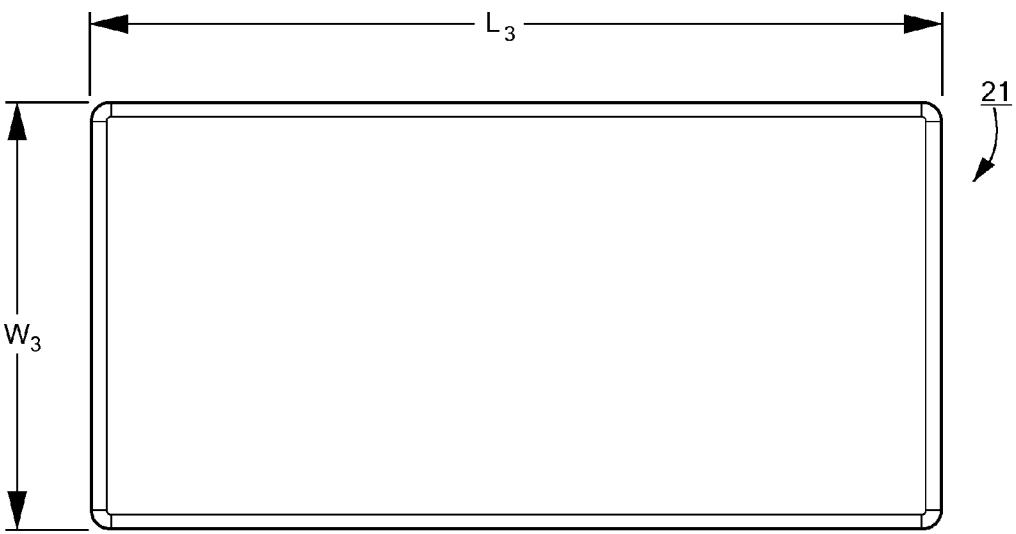
FIGS. 3(*a*)-(*c*) are top, front and right end views, respectively, of the turf pad for the rear foot support shown in FIG. 1.
Figure 3B:
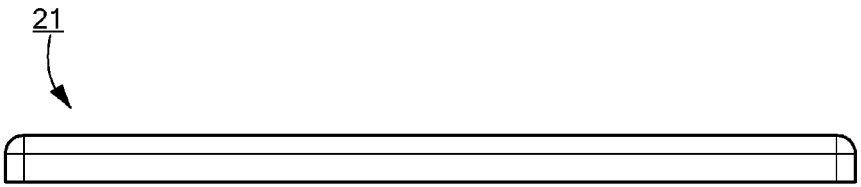
Figure 3C:
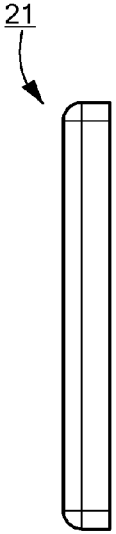
Figure 4A:
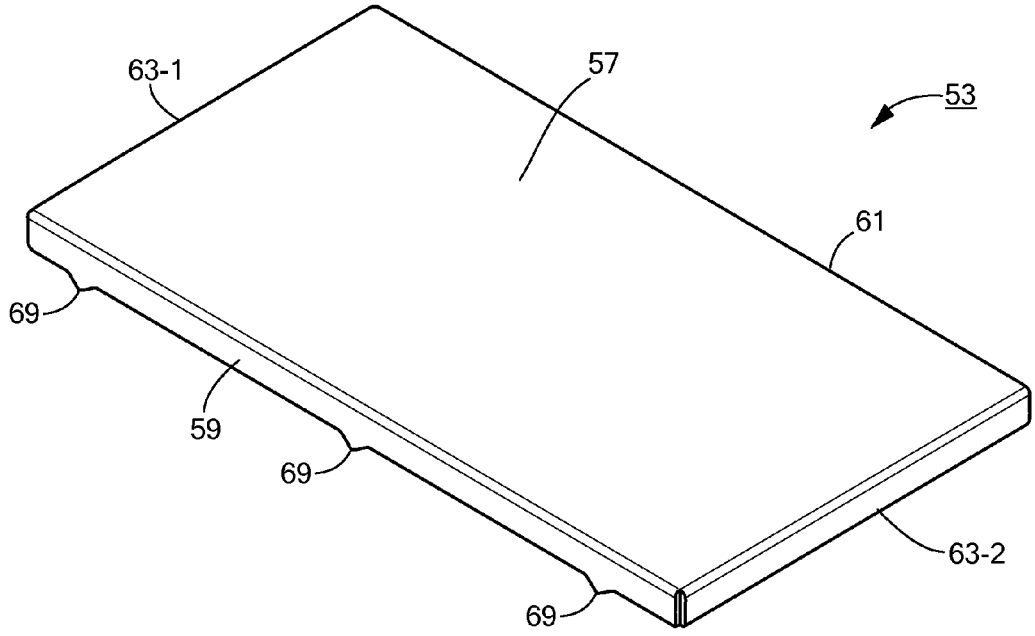
FIGS. 4(*a*)-(*d*) are top perspective, front, bottom and right end views, respectively, of the stationary platform for the front foot support shown in FIG. 1.
Figure 4B:
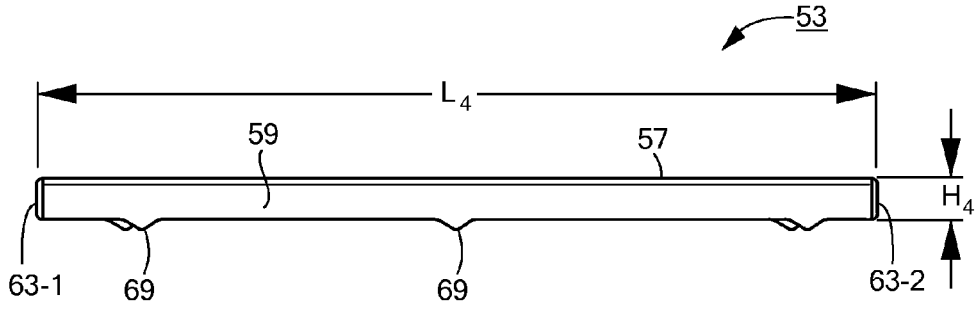
Figure 4C:
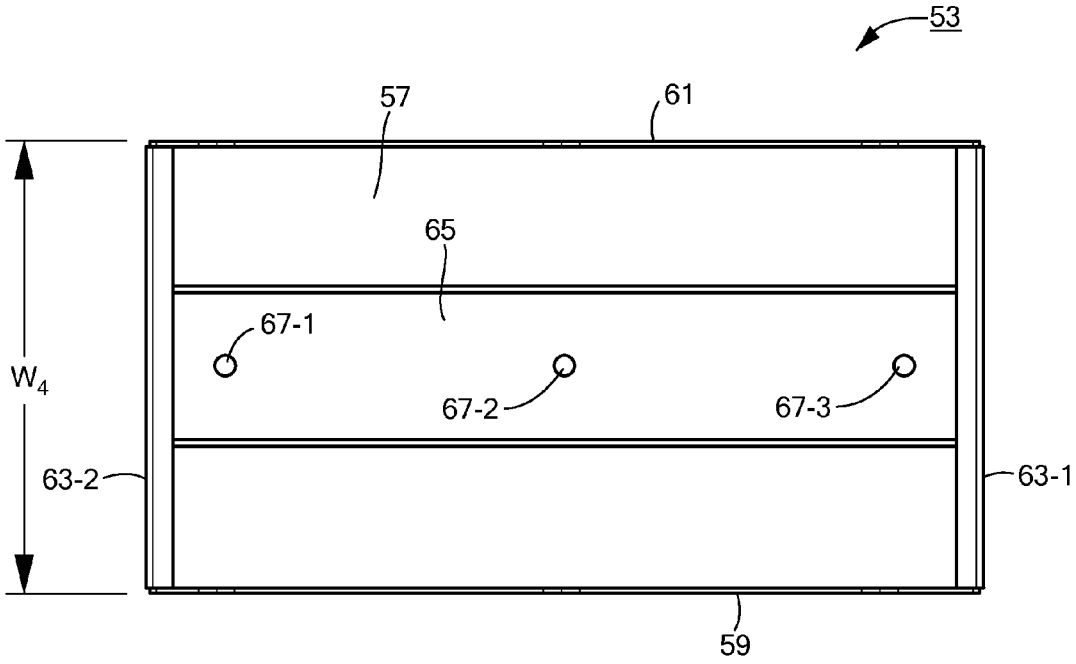
Figure 4D:
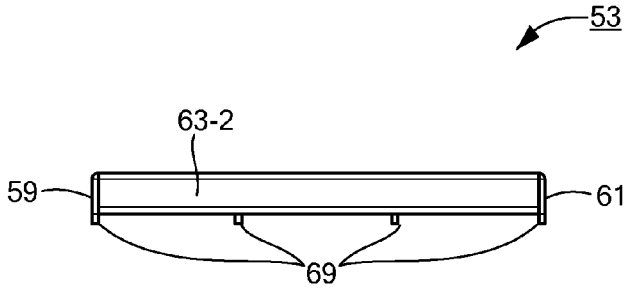

Referring back to FIG. 1, an artificial turf pad 21, shown in isolation in FIGS. 3(*a*)-(*c*), is affixed to top surface 39 of balance plate 25 by any suitable attachment means, such as an adhesive or complementary fastening elements. Turf pad 21 is preferably in the form of a strip of synthetic fibers that simulates a grass surface. In this capacity, the exposed top surface of turf pad 21 provides rear foot support 13 with a support surface that is similar in look and feel to the conditions at an actual golf course.

Turf pad 21 is generally rectangular in shape and preferably has a length $L_3$ of approximately 14.00 inches and a width $W_3$ of approximately 7.00 inches. Accordingly, it is to be understood that turf pad 21 has the same general footprint as balance plate 25 and, as a result, effectively covers the entirety of top surface 39.

Fixed front foot support 15 is a unitary device that includes a stationary platform 53 on which is mounted an artificial turf pad 55. As will be described in detail below, front foot support 15 is provided to support the front foot of a golfer at approximately the same height that support 13 holds the rear foot.

Referring now to FIGS. 4(*a*)-(*d*), stationary platform, or rise, 53 is preferably constructed from a unitary strip of rigid and durable material, such as a lightweight aluminum, that is stamped and shaped to define a main, or top, plate 57 from which protrude orthogonally down along its periphery a front wall 59, a rear wall 61 and a pair of opposing L-shaped side walls 63-1 and 63-2. As can be seen, stationary platform 53 is generally rectangular in shape and has a length $L_4$ of approximately 16.00 inches, a width $W_4$ of approximately 8.50 inches and a height $H_4$ of approximately 0.75 inches. In this capacity, platform 53 is appropriately dimensioned to support the front foot of a variety of different sized users.

In addition, a generally U-shaped bracket 65 extends longitudinally along the underside of main plate 57 and is welded thereto by three separate plug welds 67-1 thru 67-3. As can be appreciated, bracket 65 is dimensioned to provide additional structural support and stability to stationary platform 63.

A plurality of triangular projections 69 protrude down from the free ends of front wall 59, rear wall 61 and bracket 65. The sharpened tip of each projection 69 is designed to penetrate or otherwise suitably engage the ground surface on which platform 53 is disposed in order to fix platform 53 in place and prevent sliding during use. In addition, it is to be understood that projections 69 provide platform 53 with an overall height that is approximately equal to the overall height of balance device 19. As a result, a coplanar standing surface is created between rear foot support 13 and front foot support 15, which is highly desirable.

Artificial turf pad 55 is affixed to the top surface of top plate 57 by any suitable attachment means, such as an adhesive or complementary fastening elements. Turf pad 55 is similar to turf pad 21 in that turf pad 55 is preferably constructed as a strip of synthetic fibers that simulates a grass surface. In this capacity, the exposed top surface of turf pad 55 provides front foot support 15 with a support surface that is similar in look and feel to the conditions at an actual golf course.

Turf pad 55 is also generally rectangular in shape and preferably has a length of approximately 16.00 inches and a width of approximately 8.50 inches. Accordingly, it is to be understood that turf pad 55 has the same general footprint as stationary platform 53 and, as a result, effectively covers the entirety of top plate 57.

Raised ball support 17 is represented herein as an enlarged, rectangular, artificial turf pad, or practice mat, that includes a plurality of synthetic fibers that together simulate a grass surface. In this capacity, the exposed top surface of ball support 17 simulates the support and resistance of a grass-based hitting surface.

It should also be noted that the height of ball support 17 is preferably the same as the height as both rear foot support 13 and front foot support 15. In this capacity, when disposed upon a level surface, the top surfaces of supports 13, 15 and 17 are rendered generally coplanar. As a result, a uniform and level surface is created on which a golfer can stand and hit a golf ball for training purposes, which is highly desirable.

A reusable golf tee 61 is shown protruding up through ball support 17 a specified height. Reusable golf tee 61 enables a golf ball to be raised above the top surface of support 17 and thereby simulate certain types of tee shots (e.g., driving-based situations) for training purposes.

Accordingly, golf swing training kit 11 can be used in the following manner to train a golfer to, inter alia, (i) maintain lower body stability during the backswing (i.e., eliminate swaying) and (ii) initiate the downswing through hip rotation, which in turn drives the powerful lower body muscles forward along a generally linear path (i.e., using a linear power move). As part of the set-up process, the operator first positions supports 13, 15 and 17 on the flooring surface as depicted in FIG. 1 (for a right-handed golfer), with rear and front foot supports 13 and 15 spaced apart the typical width of the golfer's stance and ball support 17 disposed to the side thereof. In particular, it is essential that front end 43 of balance plate 25 be directed forward towards front foot support 15 and, in turn, the intended target (e.g., a net or a flag).

It should be noted that all of the components of training kit 11 are designed for placement upon any relatively flat flooring surface (e.g., a real or artificial grass field, cement basement, etc.). As a result, system 11 can be used frequently in a wide variety of different environments, which is highly desirable.

Figure 5A:
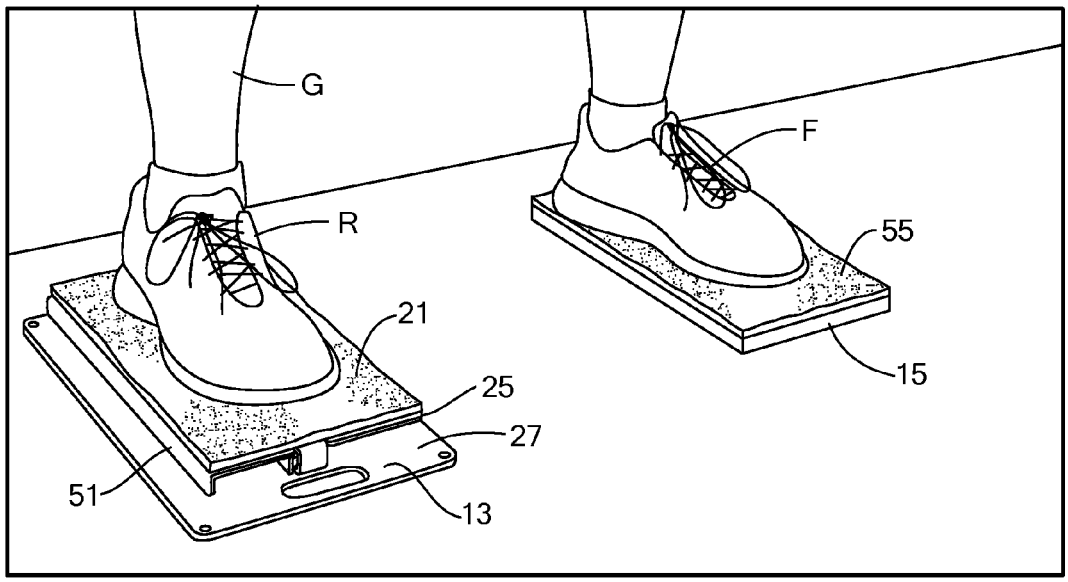
FIGS. 5(*a*) and 5(*b*) are top perspective views of selected components of the training system shown in FIG. 1(*a*), the components being shown in use by a golfer at various stages of a proper golf swing.
Figure 5B:
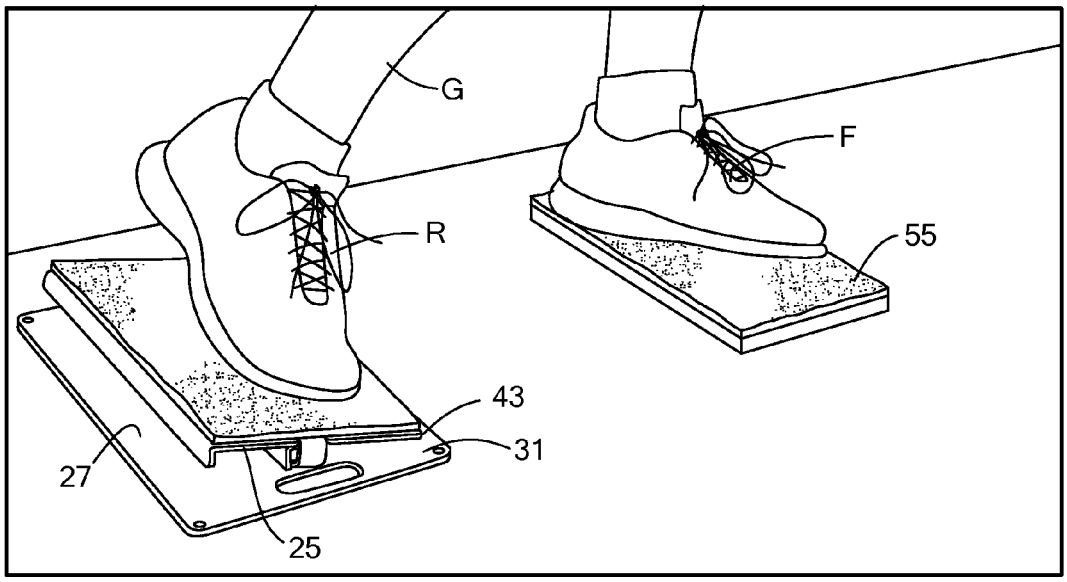

With training kit 11 arranged as such, the operator can commence the swing training process. Referring now to FIGS. 5(*a*) and (*b*), rear and front foot supports 13 and 15 are being shown used by a golfer G at distinct stages during a technically sound golf swing. In the first step of the process, the rear foot R (i.e., the right foot for a right-handed golfer) of golfer G is positioned transversely across the exposed top surface of synthetic turf pad 21 for pivotable rear foot support 13 (i.e., with the toes of a right-handed golfer pointing towards side 47-1 and arch directed towards front end 43), as shown in FIG. 5(*a*). The front foot F is then similarly positioned transversely across the exposed top surface of synthetic turf pad 55 for stationary front foot support 15. A ball (not shown) is preferably positioned on support 17 in alignment within the golfer's stance.

Once disposed in the proper set-up position, the golfer G commences the backswing by coiling the torso rearward until the back of the golfer faces the intended target. With the body coiled as such, it is to be understood that the arms draw the head of the golf club up and behind the golf ball along a planar arcuate path until the shaft of the club similarly extends in the direction of the intended target, thereby completing the backswing portion of the golf swing.

It should be noted that throughout the backswing, the lower body of the golfer should ideally remain stable, with the center of gravity maintained in alignment with the inner portion of the rear leg. In this capacity, the majority of the weight of golfer G is effectively loaded in the inner portion of the rear hip, leg and foot. With the weight of the golfer G stabilized as such, balance plate 25 remains horizontally disposed and in parallel with ground plate 27, as seen in FIG. 5(*a*).

It is to be understood that any rearward weight shift during the backswing (i.e., as a result of swaying) would cause balance plate 25 to pivot backward which, in turn, would cause flange 51 to strike ground plate 27 with enough force to create an auditory signal. In this manner, training device 11 provides the hitter with immediate negative feedback, which is highly desirable in an effort to eliminate swaying.

To initiate the downswing, golfer G rapidly rotates the hips open which, in turn, drives the lower body linearly forward. This linear power move transfers the majority of the weight of golfer G linearly forward, with the rear hip and knee of golfer G advancing in front of rear foot R. When completed properly, the linear power move causes balance plate 21 to pivot forward until front end 43 of balance plate 25 strikes top surface 31 of base 27, as shown in FIG. 5(*b*).

It should be noted that the aforementioned weight transfer causes balance plate 25 to contact base 27 with a significant amount of force which, in turn, creates a substantial auditory signal (e.g., a load metal clanking noise). In addition, the forward articulation of balance plate 25 provides golfer G with a sensory reaction (i.e., the sensation of teetering forward). Accordingly, it is to be understood that golfer G is instantly provided with both auditory and tactile feedback from device 19 that the magnitude and timing of the linear power move has been properly executed, which is a principal object of the present invention. By contrast, if the golfer G fails to initiate the downswing by firing the hips open, the lack of an auditory or tactile response immediately notifies the user of a lack and/or mistimed lower body drive.

The considerable lower body momentum initiated through the linear component then powers, or transitions into, rotation of the upper body. Specifically, the acceleration of the body weight linearly forward powers the rapid rotation of the torso, shoulders, arms and hands of golfer G as part of a kinetic chain of movement. This rapid rotation drives the golf club into impact with considerable acceleration and power, which is highly desirable.

The embodiment shown of the present invention is intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A training system, comprising:

(a) a pivotable rear foot support, the rear foot support comprising, (i) a support member; and (ii) a balance plate pivotally coupled to the support member, the balance plate having a flat top surface, a flat bottom surface, a front end and a rear end, the balance plate being naturally biased to balance on the support member along a generally horizontal plane in the absence of a force applied thereto, the balance plate being adapted to teeter from the horizontal plane in both a forward and rearward direction; and (b) a stationary front foot support comprising a raised platform that is shaped to include a flat top plate, (c) wherein, in the absence of a force applied thereto, the flat top surface of the balance plate lies in parallel with the top plate of the stationary front foot support; and a downwardly extending projection formed onto rear end of the balance plate, the projection being spaced apart from the support member when the balance plate is balanced on the support member in the horizontal plane, the projection being dimensioned to selectively contact the support member when the balance plate teeters from the horizontal plane in the rearward direction.

2. The training system of claim 1 wherein the height of the pivotable rear foot support and the height of the stationary front foot support are approximately equal.

3. The training system of claim 2 further comprising a raised ball support, the height of the raised ball support being approximately equal to the height of the front and rear foot supports.

4. The training system of claim 1 wherein the front end of the balance plate is adapted to selectively contact the support member when the balance plate teeters from the horizontal plane in the forward direction.

5. The training system of claim 1 further comprising a turf pad affixed to the top surface of the balance plate.

6. The training system of claim 1 wherein the support member for the rear foot support comprises:

(a) an enlarged base having a top surface and a bottom surface, and (b) a transverse mounting bracket formed on the top surface of the base, (c) wherein the bottom surface of the balance plate is mounted on the transverse mounting bracket and is adapted to teeter thereon.

7. The training system of claim 1 further comprising a turf pad affixed to the flat top plate of the raised platform.

8. The training system of claim 7 wherein the raised platform includes a plurality of downwardly extending projections.

9. The training system of claim 8 wherein each projection is generally triangular in shape.

10. A method of training a golfer to swing using proper mechanics, the method comprising the steps of:

(a) providing a training system that comprises a stationary front foot support and a pivotable rear foot support, the stationary front foot support comprising a raised platform that is shaped include a flat top plate, the rear foot support comprising a support member and a balance plate pivotally coupled to the support member, the balance plate having a flat top surface, a flat bottom surface, a front end and a rear end, the balance plate being naturally biased to balance on the support member along a generally horizontal plane in the absence of a force applied thereto, the flat top plate of the raised platform lying in parallel with the horizontal plane, wherein the top surface of the balance plate being adapted to teeter from the horizontal plane in both the forward and rearward direction;

(b) placing the front foot of the golfer transversely across the front foot support and the rear foot of the golfer transversely across the rear foot support;

(c) maintaining the weight of the golfer in alignment with the inner portion of the rear hip, leg and foot during the backswing;

(d) initiating the downswing through rotation of the hips, thereby transferring the weight of the golfer linearly forward such that the balance plate pivots forward and contacts the support member; and (e) after the initiating step, rotationally driving the torso of the golfer to swing the golf club.

11. The method as claimed in claim 10 wherein the contact established between the balance plate and the support member during the initiating step generates an audible signal.

12. The method as claimed in claim 10 wherein the balance plate remains in the generally horizontal plane throughout the maintaining step.

* * * * *